United States Patent [19]

Braün et al.

[11] 4,143,828

[45] Mar. 13, 1979

[54] WINDER FOR A PAPERMAKING MACHINE

[75] Inventors: Heinz Braün, Ravensburg; Karl Kiesel, Mochenwangen; Wolf-Günter Stotz, Ravensburg, all of Fed. Rep. of Germany

[73] Assignee: Escher Wyss GmbH, Ravensburg, Württenburg, Fed. Rep. of Germany

[21] Appl. No.: 899,283

[22] Filed: Apr. 24, 1978

[30] Foreign Application Priority Data

Apr. 26, 1977 [CH] Switzerland ..... 5157/77

[51] Int. Cl.[2] ..... B65H 17/08

[52] U.S. Cl. ..... 242/65; 242/67.1 R; 242/75.1

[58] Field of Search ..... 242/65, 67.1 R, 66, 242/67.2, 67.3 R, 75, 75.1, 68.7, DIG. 3

[56] References Cited

U.S. PATENT DOCUMENTS

| | | | |
|---|---|---|---|
| 2,367,777 | 1/1945 | Hornbostel | 242/66 |
| 3,202,376 | 8/1965 | Dutro | 242/75.1 |
| 3,365,141 | 1/1968 | Soloduk | 242/65 X |
| 3,889,892 | 6/1965 | Melead | 242/65 |

*Primary Examiner*—Edward J. McCarthy
*Attorney, Agent, or Firm*—Werner W. Kleeman

[57] ABSTRACT

A winder for a papermaking machine comprising a cylinder over which there is guided the paper web which is to be wound-up. A reel-spool receives the wound-up paper roll or package and a contact or press device presses the reel-spool in the direction of the cylinder. An endless band arrangement is guided such that it extends over the cylinder between its surface and the paper web, the band arrangement in conjunction with the paper web being wrapped about part of the circumference or outer surface of the cylinder and extends between the cylinder and the reel-spool or, as the case may be, the paper roll or package wound upon the reel-spool. The band arrangement also encloses the paper roll or the reel-spool along part of its circumference.

6 Claims, 2 Drawing Figures

WINDER FOR A PAPERMAKING MACHINE

BACKGROUND OF THE INVENTION

The present invention relates to a new and improved construction of winder or winder apparatus for a papermaking machine, sometimes simply referred to as a paper machine, which is of the type comprising a cylinder over which there is guided the paper web which is to be wound-up, a reel-spool for taking-up the wound paper roll or package and a press or contact device for pressing the reel-spool in the direction of the cylinder.

With a winding apparatus of this type, which is known in this field of technology under the designation "Pope roller" or "support cylinder-roller", it is possible with the aid of a driven cylinder to wind-up the paper upon a reel-spool or the like. The reel-spool itself is not provided with any drive and is merely driven by friction. Additionally, it is possible by means of a simple change mechanism to doff or remove a fully wound paper roll and to infeed a new reel-spool upon which there is then continued the winding operation.

These winders generally operate satisfactorily. However, when processing certain paper qualities, especially soft tissue paper, difficulties arise. Thus, when winding-up tissue paper the formed paper roll is wound too loosely, so that there exists the danger that it tends to slide laterally. Therefore, it is not possible to obtain the desired taut winding or wound paper roll merely by carrying out the usual change in the contact force.

SUMMARY OF THE INVENTION

Therefore, it is a primary object of the present invention to provide a new and improved construction of winder apparatus for a paper machine which is not associated with the aforementioned drawbacks and limitations of the prior art equipment as discussed above.

Another and more specific object of the present invention is to provide a new and improved construction of a winder apparatus of the previously mentioned type, by means of which, while employing extremely simple means, there can be produced the desired taut, however not too tight winding of the paper web upon the reel-spool, and further, effectively avoiding the aforementioned drawback of lateral sliding or slippage of the paper roll during the winding operation and during transport.

Still a further significant object of the present invention aims at providing a new and improved construction of winder for paper machines which is relatively simple in construction and design, economical to manufacture, extremely reliable in operation, provides for properly wound packages of paper upon a reel-spool, is not readily prone to breakdown or malfunction, and requires a minimum of maintenance and servicing.

Now in order to implement these and still further objects of the invention, which will become more readily apparent as the description proceeds, the winder apparatus or winder of the present development is manifested by the features that there is provided an endless band arrangement guided over the cylinder between the surface thereof and the paper web. This band arrangement in conjunction with the paper web is trained or wrapped about the cylinder along part of its circumference. Further, this band arrangement is guided between the cylinder and the reel-spool or the paper roll which is wound thereon, as the case may be, and such band arrangement also is trained or wrapped about part of the circumference of the paper roll or the reel-spool.

Preferably, the band arrangement, considered with regard to the direction of travel of the paper web, is guided in such a manner in front of the cylinder along the paper web which travels towards the cylinder that the paper web, prior to coming into contact with the cylinder, bears upon the band arrangement which is preferably in the form of a filter band e.g. a perforated band or sieve. Due to this measure there can be avoided the disturbing fluttering of the paper web in front of the cylinder, i.e., at its infeed side, which arises in many instances.

Moreover, the section where the paper web bears upon the band arrangement can be provided with a pneumatic holder or adhering device. This holder or adhering device can be constituted, for instance, by a suction box or equivalent structure located at one side or face of the band arrangement or can comprise a blower device arranged at the side of the paper.

It is also within the teachings of the present invention to design the winder such that during operation there exists a spacing between the surface of the cylinder and the wound paper roll or package. In such case the reel-spool together with the paper roll or package is solely driven by the band arrangement and not by frictional contact with the cylinder. This contributes to improving the winding operation. It is possible, with this construction, for the air at both sides or faces of the paper web and contained in the paper web itself to escape without being hindered, both before and during such time as the paper web is placed upon the prior coil wrapping or winding of the paper roll.

It is preferable if the band arrangement is in the form of a filter or sieve band which insures for a uniform contact force over the entire width of the paper roll with simultaneous throughpassage of the air. However, it should be understood that a different construction is conceivable, for instance employing a multiplicity of narrow, parallel bands. In certain cases, where there is not attributed any particular significance to the air passage through the band arrangement, there can then be employed an air impervious or solid band or belt, for instance a rubber band or a felt band or the like.

BRIEF DESCRIPTION OF THE DRAWINGS

The invention will be better understood and objects other than those set forth above, will become apparent when consideration is given to the following detailed description. Such description makes reference to the annexed drawings wherein.

DETAILED DESCRIPTION OF THE PREFERRED EMBODIMENTS

Figure 1:
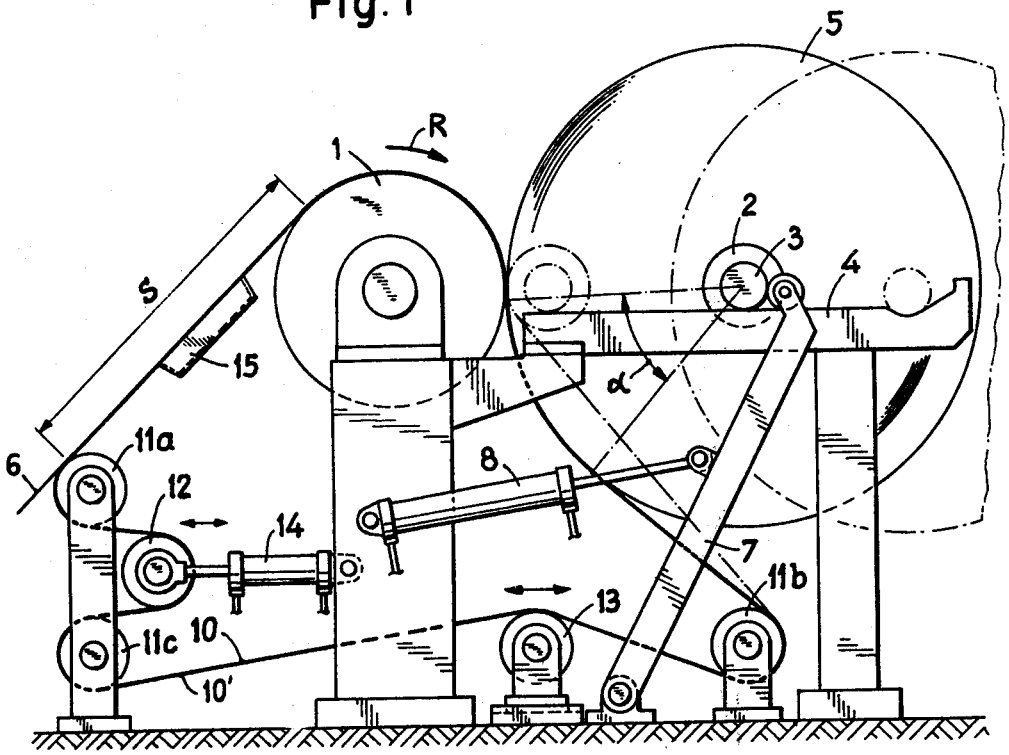
FIG. 1 is a schematic illustration of winder apparatus constructed according to the present invention.

Describing now the drawings, in FIG. 1 there is shown in schematic simplified illustration a winder apparatus for a paper machine as contemplated by the teachings of the present invention. This winder apparatus will be seen to comprise a support cylinder 1, driven in known and therefore not particularly illustrated manner by any suitable drive. Additionally, the winder apparatus comprises a reel-spool 2 or equivalent wind-up member or core for the paper web. This reel-spool 2 bears by means of its journals 3 at opposed ends thereof upon guide means 4. Wound onto the reel-spool 2 is a paper roll or package 5 from a paper web 6 which is infed thereto by means of the support cylinder 1. The reel-spool 2 together with the wound paper roll 5 is pressed in known manner by the contact or press arms 7, which for instance are controlled by a pneumatic servomotor 8 or equivalent drive, in the direction of the support cylinder 1. To simplify the illustration there is only visible in FIG. 1 the parts of the winder apparatus, such as the portion of the guide means 4 and the one contact or press arm which is closer to the viewer of the showing of FIG. 1.

During operation of this winder apparatus, which as concerns the parts thereof which have been just described above are conventional, the paper web 6 is delivered to the support cylinder and then guided from such cylinder 1 to the reel-spool 2 where it is wound-up into a paper roll or package 5. The reel-spool 2 and the paper roll 5 which forms thereon were heretofore driven by the frictional contact of such components with the surface of the support cylinder 1, and while under the action of the contact or press arms 7. Hence, as the diameter of the wound paper roll 5 increased during the winding operation the arms 7 laterally shift, to enable the build-up of the paper roll or package 5.

Also for reasons of simplifying the showing of FIG. 1, there have been conveniently omitted from the drawings parts of the apparatus which are not directly related to the teachings of the present invention, such as for instance the arms for the infeed of new reel-spools. Since such equipment is conventional and has no direct bearing on the underlying principles of the present invention it is unnecessary to further consider the same herein.

Now according to the teachings of the present invention the winder apparatus is advantageously equipped with a band arrangement 10', preferably, although not absolutely necessary in all instances, constituted by a filter or sieve band or belt 10. This filter band 10 can be preferably a plastic filter or sieve unit, for instance formed of polyester. The filter band 10 is guided below the paper web 6 which is moving in a predetermined direction of travel into and through the winder apparatus and specifically towards and onto the support cylinder 1. Now such filter band 10 which moves below the paper web 6 is guided over the support cylinder 1, is wrapped or trained about at least a part of the surface or circumference thereof, as shown, then moves between such support cylinder 1 and the paper roll 5 and the reel-spool 2 and likewise partially wraps about the circumference or outer surface of the paper roll 5 or the empty reel-spool 2, as the case may be. Additionally, the filter band 10 is guided over the guide rolls **11*a*, 11*b*, 11*c*, a tensioning roll 12 as well as a control or regulating roll 13. The tensioning roll 12 beneficially serves to maintain a certain tension at the filter band or filter means 10 and like the contact or press arms 7 can be loaded i.e. tension-controlled by the pneumatic servomotors 14 or equivalent structure. The control or regulating roll 13 serves in known manner for laterally guiding the filter band 10, so that such does not laterally shift out of its working zone at the support cylinder 1 and the guide rolls 11*a*, 11*b*, 11*c***.

As also apparent by referring to FIG. 1, at the section S, extending between the guide roll **11*a* and to the immediate run-on or infeed side of the support cylinder 1, with respect to the direction of movement R of the paper web 6, the filter band or filter means 10 is guided along the paper web 6, so that such can snugly bear against such filter band 10. Below the filter band 10 there is arranged at the section S a schematically illustrated pneumatic holder or adhering device, here shown in the form of a suction box 15 which insures for the proper contacting relationship of the paper web 6 against the filter band 10** in this section S.

During operation the paper web 6 is applied by the filter band 10 onto the paper roll 5 which is being formed along a path corresponding to the contact or wrap angle $\alpha$ and pressed against the paper coil or winding which has already been last-formed upon the paper roll or package 5. The air entrained by the soft tissue paper, which partially is located between the fibers thereof, can escape, so that there is produced the desired taut winding action. The reel-spool 2 and the paper roll 5 which is being formed is simultaneously driven by the filter band 10.

The desired degree of tautness i.e., the density of the wound paper package can be influenced by the tensioning force of the filter band 10, i.e., by the contact force exerted by the servomotors 8 and 14. There can even be undertaken measures which have not here been particularly shown, for the purpose of varying such tensioning force during operation in a manner such that the same is different for different diameters of the wound-up paper rolls 5. Thus, for instance, at the start of the winding of the paper roll or package 5 there can be provided a greater pressure between the filter band 10 and such roll 5 than towards the end of such winding operation.

Figure 2:
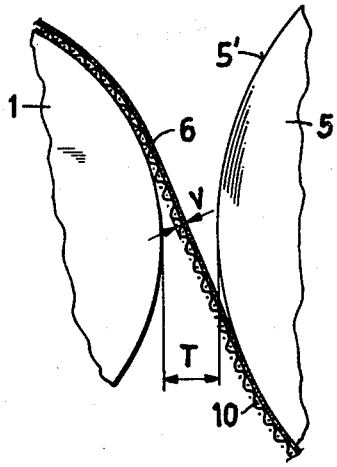
FIG. 2 is a detailed sectional view of part of the arrangement of FIG. 1 on an enlarged scale, wherein a spacing exists between the surface of the paper roll and the paper web infed by the cylinder.

Since the reel-spool 2 and the paper roll 5 are driven by the filter band 10 there is not absolutely required any direct contact of the surface of the paper roll 5 with the paper web 6 bearing upon the support cylinder 1. In fact, it can even be advantageous if, according to the modified construction of FIG. 2, there is provided a spacing T between the surface or circumference 5' of the paper roll 5 and the surface or circumference of the cylinder 1, which spacing T is greater than the collective thickness V of the filter band 10 and the paper web 6. In this way there is beneficially obtained space for the escape of the air entrained by the paper web 6 to both sides, so that such air cannot become entrapped beneath the just wound wrapping or coil and disturb the winding operation.

Although the invention has been described by way of example in conjunction with a band in the form of a filter or sieve band, it should be clearly understood that the band arrangement constituting the filter band also can be differently designed. Thus, for instance, there may be provided a plurality of narrow, parallely extending bands or belts. As also previously explained, in those instances where there is not placed any particular importance upon the air permeability or passage of air through the band arrangement, there can be used instead of the filter band 10 a rubber band or felt band or the like which extends over the entire width of the paper roll. The filter band 10 can be driven by the cylinder 1 or by one of the rolls over which it is guided, for instance one of the guide rolls **11*a*, 11*b*, 11*c***.

While there are shown and described present preferred embodiments of the invention, it is to be distinctly understood that the invention is not limited thereto, but may be otherwise variously embodied and practiced within the scope of the following claims. Accordingly,

What we claim is:

1. A winder apparatus for a paper machine comprising:

a cylinder having an outer surface over which there is guided a paper web moving in a predetermined direction of travel and which is to be wound-up into a paper roll;

a reel-spool for receiving the paper web from the cylinder and for winding-up such paper web thereon into a paper roll;

a contact device for pressing the reel-spool in the direction of the cylinder;

an endless band arrangement; and guide means for guiding said endless band arrangement so as to extend over said cylinder between said outer surface and the incoming paper web;

said guide means further guiding said band arrangement such that said band arrangement together with said paper web wraps about part of the circumference of the cylinder, is guided between the cylinder and the reel-spool or the paper roll wound on such reel-spool and is trained about part of the circumference of the paper roll or the reel-spool when empty.

2. The apparatus as defined in claim 1, wherein:

said guide means, viewed in the direction of travel of the paper web, guides said band arrangement forwardly of the cylinder along the paper web which travels towards and onto the cylinder such that the paper web bears against the band arrangement at a location forwardly of the cylinder.

3. The apparatus as defined in claim 2, wherein:

said paper web bears against said band arrangement along a predetermined section of said band arrangement; and a pneumatic holder device provided for said section for holding the paper web against the band arrangement at said section.

4. The apparatus as defined in claim 1, wherein:

said cylinder and the wound paper roll on the reel-spool are arranged relative to one another such that during the winding operation a spacing is present between the outer surface of said cylinder and the wound paper roll which is greater than the combined thickness of the paper web and said band arrangement.

5. The apparatus as defined in claim 1, wherein:

said band arrangement comprises a filter band.

6. A winder apparatus for a paper machine comprising:

a cyliinder having an outer surface over which there is guided a paper web moving in a predetermined direction of travel and which is to be wound-up into a paper roll;

spool means for receiving the paper web from the cylinder and for winding-up such paper web thereon into a paper roll;

means for urging the spool means in the direction of the cylinder;

an endless band arrangement; and guide means for guiding said endless band arrangement so as to extend over said cylinder between said outer surface and the incoming paper web;

said guide means further guiding said band arrangement such that said band arrangement wraps about part of the circumference of the cylinder, is guided between the cylinder and the spool means or the paper roll wound on such spool means and is wrapped about part of the circumference of the paper roll or the spool means.

* * * * *